US005279774A

United States Patent [19]

Remy et al.

[11] Patent Number: 5,279,774

[45] Date of Patent: Jan. 18, 1994

[54] CONTACT FILLING FOR COOLING TOWERS

[76] Inventors: Helmut L. Remy, Rua Marie Satzke, 140; Carlos Von Wieser, Rua Marie Satzke, 106, both of, Sao Paulo 04664-150-SP, Brazil

[21] Appl. No.: 990,050

[22] Filed: Dec. 14, 1992

[51] Int. Cl.[5] ..... B01F 3/04

[52] U.S. Cl. ..... 261/111

[58] Field of Search ..... 261/111

[56] References Cited

U.S. PATENT DOCUMENTS

| | | | |
|---|---|---|---|
| 2,239,936 | 4/1941 | Simons | 261/111 |
| 3,389,895 | 6/1968 | DeFlon | 261/111 |
| 3,879,502 | 4/1975 | Furlong et al. | 261/111 |
| 4,576,764 | 3/1986 | Shepherd et al. | 261/111 |
| 4,774,034 | 9/1988 | Fritz | 261/111 |
| 5,112,537 | 5/1992 | Kinney, Jr. | 261/111 |

FOREIGN PATENT DOCUMENTS

| | | | |
|---|---|---|---|
| 1278418 | 6/1972 | United Kingdom | 261/111 |

*Primary Examiner*—Tim Miles

*Attorney, Agent, or Firm*—Ladas & Parry

[57] ABSTRACT

The present invention refers to improvements in contact filling for cooling towers, of the type comprising prismatic triangular bars (1) made of plastic material and arranged in multiple parallel horizontal layers, one lateral plan face thereof being turned upwards, the improvements comprising a support structure having the shape of a vertical grill (2) with lozenge-shaped meshes, said support structure intended to provide stable support to said bars (1) which are stably seated by their peaks and flanks, each of said bars (1) further including an inner longitudinal edge extending in one or in a pair of longitudinal rectilinear rules (3), whose completely free edge is cut in transversal teeth (4) having negative hollow intended to obtain attachment over the grill seats (2), as well as to impede formation of liquid grooves or beads along the rules (3).

2 Claims, 1 Drawing Sheet

CONTACT FILLING FOR COOLING TOWERS

The present invention refers to contact fillings, particularly those used in connection with cooling towers.

It is known that in general cooling towers are units having a great size used to dissipate heat in thermoelectrical, electronuclear, petrochemical, cooling installations or others.

Said cooling towers are usually equipped in their inner parts with a contact filling which is responsible for the creation of a medium or internal environment to be followed by the hot liquid in a determined direction, but under the action of a gas current following a different direction.

Said gas current in its turn is intended for the absorption of the heat of that liquid so as to drain it to the atmosphere, and also for the recovery for new utilization of said liquid duly cooled.

Therefore, the constant objective, or challenge for those persons skilled in the art of contact fillings for cooling towers, and also washers, gas absorbers or eliminators in contact with liquids, has always been to be able to achieve, under a conjugated and optimized way, a series of positive characteristics, with special note to the following:

low resistance to the gas flow;

high efficiency in thermal exchange and/or great specific surface (m2/m3);

long durability; and reduced tendency to obstruction by accumulated solids.

Among the various types of contact fillings which are already known and largely used, are those formed by prismatic triangular bars made of wood. Said bars are arranged in multiple parallel and horizontal layers having one lateral plan face turned upwards, for receiving sprinkles by gravity or pressure. Naturally, said contact filling is intended to be used in connection with countercurrent cooling towers.

With a contact filling so constructed, including the aerodynamic profile of a triangle arranged with a vertix turned downwards, i.e. upwards the gas current, this latter's resistance is thus reduced. As a result, there is obtained a little turbulent flow, and the first of the aforementioned characteristics is then fully met.

On the other hand, the continuous descendent re-pulverization of the liquid "rainfall", following the layer on layer impact over the plan and horizontal faces of the filling multiple prismatic triangular bars, and in view of the efficient utilization of the kinetic energy of the falling drops, makes it possible to obtain an optimized volume of drops finely pulverized and exposed to the gas in counterflux. Therefore, there is assured rigid compliance to the second aforementioned characteristic desired to be achieved.

However, with regard to the other two characteristics, the conventional contact filling is not capable of showing the same efficiency, be it in view of its durability, which is naturally limited by the eventual decomposition of the commercially available wood, or be it by the fact that it includes absorbing and porous surfaces, which in a certain way enhances obstruction by accumulated solids.

In view of the above disadvantages, it has been found necessary to replace the traditional sprinkle bars made of wood, by bars made of plastic material. Said plastic bars would solve the problem of durability, in view of the total lack of possibility of material rottenness, and it would also solve the problem of obstruction by accumulation of solids, as the plastic material has smooth polished surfaces. Said surfaces repel formation of moss encrustation.

However, pure and simple utilization of bars made of plastic material, having the same prismatic rectangular shape, and being arranged in the same manner as those made of wood, would not cause to be obtained an adequate step by step redistribution of the liquid "rainfall" during filling. The smooth and continuous surface of the plastic would aid formation of grooves (beads) or liquid draining channels, thereby jeopardizing thermal exchange and gas absorption or washing.

Furthermore, the use of said bars made of plastic material would likewise require a suitable support for the bars. Of course, said support would need to be made of materials compatible with the qualities of the plastic bars, and which would allow for the necessary dismounting/remounting facilities.

In order to overcome the above inconveniences, the present invention provides improvements in contact filling for cooling towers.

It is one objective of the present invention to achieve the necessary improvements by using means which despite being simple are highly practical and clever.

The object of the present invention is to allow for the efficient utilization of the sprinkle bars made of plastic material having the same prismatic and triangular shape as the conventional ones made of wood. The improvements of the present invention result in perfect step by step filling redistribution of the descendent liquid "rainfall", thus causing to achieve absolutely efficient thermal exchange, gas absorption and washing.

As part of said improvements, the present invention provides a new support structure mounting said sprinkle bars, which is capable of providing perfect and practical conditions for a stable settling of the bars. The use of the new support structure is further useful to maintain vertical alignment of the steps, and ideal facilities are obtained for eventual dismounting or remounting during new utilizations.

The present invention will now be described with reference to the attached drawings in which.

According to the drawings, the improvements of the present invention refer to contact fillings used in countercurrent cooling towers of the type comprising prismatic triangular bars 1 arranged in multiple parallel horizontal layers having one lateral plan face turned upwards, and the corresponding opposite edge turned downwards, said bars being made of plastic material.

Figure 1:
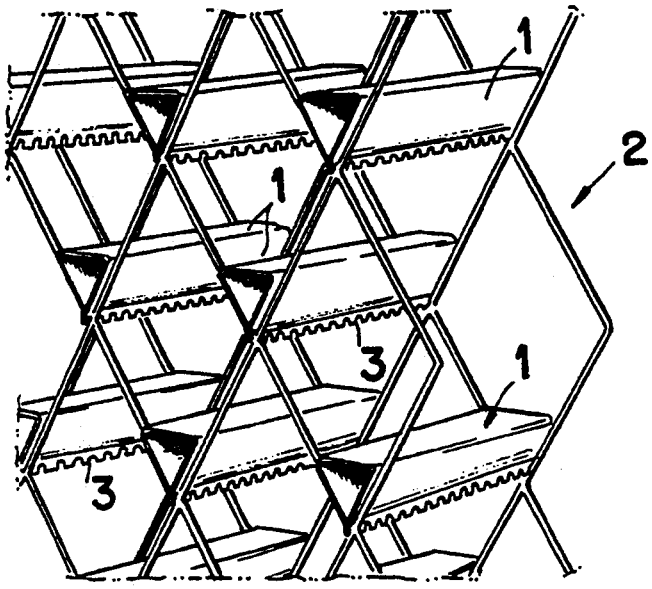
FIG. 1 is a perspective view of the improved contact filling mounted on a respective support structure.
Figure 3:
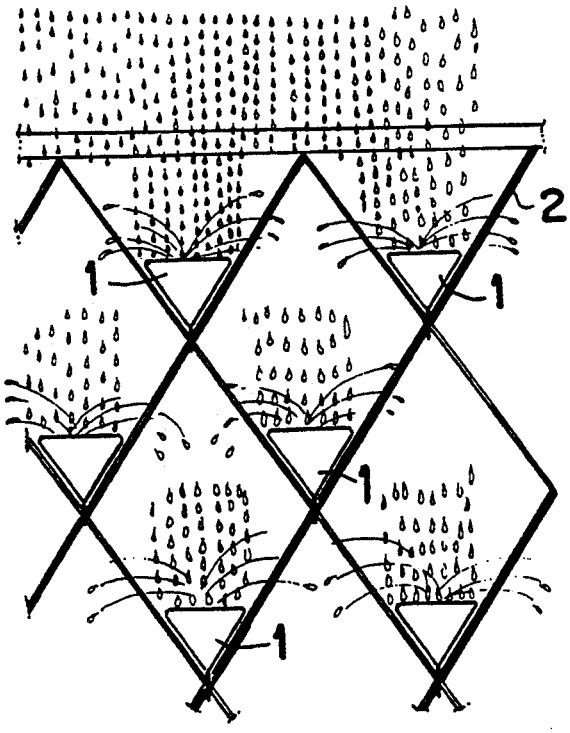
FIG. 3 is an upper view of the contact filling of FIG. 1, including illustration of the step by step redistribution of the descendent liquid "rainfall".

The contact filling according to the present invention comprises a new support structure for supporting said prismatic triangular bars 1 in their arrangement. Said structure is constituted by a vertical grill 2, a lozenge-shaped mesh (FIG. 1) including acute angles with the same inclination as that of the lateral faces of the prismatic triangular bars 1, in order to provide perfect settlement of peaks and flanks of said bars. As a result of such a settlement, vertical alingment of the steps is maintained (FIG. 3). Said vertical grill 2 is made of plastic reinforced with glass, or other materials compatible with the gases and liquids which are processed inside the cooling tower.

Figure 2:
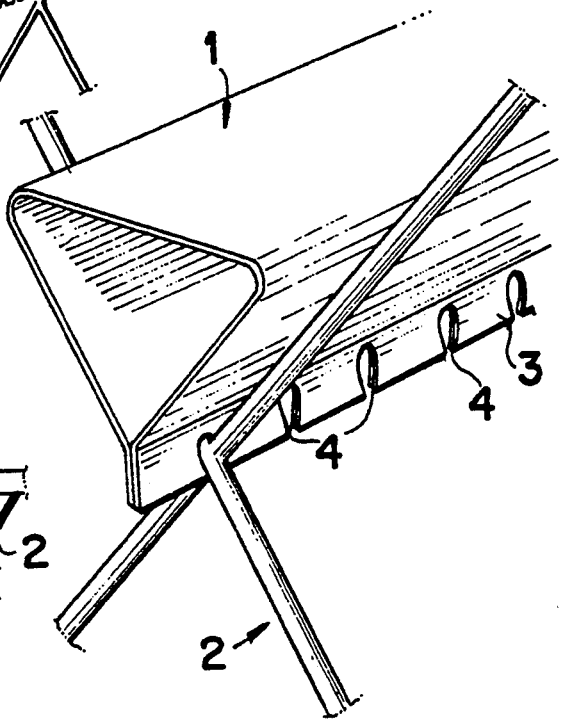
FIG. 2 is a perspective view of a sprinkle bar showing how it is fixed to the support structure.

Moreover, as part of the above-mentioned improvements, said prismatic triangular bar 1 includes a longitudinal inner edge extending in one or in a pair of juxtaposed longitudinal rectilinear rules 3. The completely free edge of said rules 3 includes transversally cut teeth 4 having negative hollow, and being distributed at regular intervals. Said teeth 4 provide stable attachment of bar 1 to said support structure 2 (FIG. 2), as well as impede formation of grooves or beads for the liquid along rules 3.

When using smooth plastic bars, suitable redistribution of the "rainfall" (which in the case of using bars made of wood is facilitated by the absorbing and porous surface of the material of the bar itself) is provided by said toothed rules 3, whose teeth 4 being reopened layer by layer impede channel concentration (beads). On the other hand, the geometric shape of teeth 4 having negative hollow is used to attach by pressure the bars to their seats in said grills 2 (FIG. 2), thereby avoiding the need of using other attachment members.

In opposition to what occurs with respect to those conventional bars made of wood, the completely smooth surfaces of the prismatic triangular bars made of plastic are repulsive to moss encrustation formation in the water cooling towers. Such an effect of eliminating solid depositions (not for chemical encrustating) over the bar surfaces results from the impact power of the liquid falling in a true "self-washing" effect.

We claim:

1. Improvements in contact filling for cooling towers of the type comprising prismatic triangular bars, arranged in multiple parallel horizontal layers, one lateral plan face thereof is turned upwards and the corresponding opposite longitudinal edge is turned downwards, said bars being made of plastic material, the improvements being characterized by comprising a support structure for said prismatic triangular bars (1) following a given arrangement; said support structure being constituted by a vertical grill (2), lozenge-shaped meshes having acute angles with the same inclination as that of the lateral faces of the prismatic triangular bars (1), on which said bars seat stably supported by their peaks and flanks; said grill is made of plastic reinforced with glass or other materials compatible with the gases and liquids which are processed inside the cooling tower.

2. Improvements in contact filling for cooling towers, according to claim 1, characterized in that each of said prismatic triangular bars (1) forming the filling, include an inner longitudinal edge extending in one or in a pair of longitudinal rectilinear rules (3), whose completely free edge includes transversally cut teeth (4) with negative hollow, and which are distributed at regular intervals; said teeth serving for attaching the support structure (2), as well as for impeding formation of liquid grooves or beads.

* * * * *